US007291780B2

(12) United States Patent
Hosler

(10) Patent No.: US 7,291,780 B2
(45) Date of Patent: Nov. 6, 2007

(54) TRANSDUCER FOR CONVERTING BETWEEN MECHANICAL VIBRATION AND ELECTRICAL SIGNAL

(75) Inventor: David Hosler, El Cajon, CA (US)

(73) Assignee: Taylor-Listug, Inc., El Cajon, CA (US)

( * ) Notice: Subject to any disclaimer, the term of this patent is extended or adjusted under 35 U.S.C. 154(b) by 581 days.

(21) Appl. No.: 10/759,442

(22) Filed: Jan. 15, 2004

(65) Prior Publication Data

US 2004/0184631 A1 Sep. 23, 2004

Related U.S. Application Data

(63) Continuation-in-part of application No. 10/085,975, filed on Feb. 26, 2002, now Pat. No. 7,132,597.

(51) Int. Cl.
*G10H 3/14* (2006.01)

(52) U.S. Cl. ..... 84/725; 84/723

(58) Field of Classification Search ..... 84/725–728, 84/723, 743; 381/162, 163, 165, 166; 310/12, 310/15, 20, 23, 30; 73/650, 672, 649, 654, 73/510, 632, 514.31; 324/207.23
See application file for complete search history.

(56) References Cited

U.S. PATENT DOCUMENTS 2,525,456 A * 10/1950 Merrill ..... 310/211
2,680,986 A * 6/1954 Company ..... 84/726
3,624,264 A 11/1971 Lazarus
3,725,561 A 4/1973 Paul
4,010,334 A 3/1977 Demeter
4,237,347 A 12/1980 Burundukov
4,338,823 A * 7/1982 Iwasaki ..... 73/654
4,504,932 A 3/1985 Sundt
4,535,668 A * 8/1985 Schaller ..... 84/727
4,678,616 A 7/1987 Kawashima
4,922,753 A * 5/1990 Idogaki et al. ..... 73/514.08
5,225,770 A * 7/1993 Montagu ..... 324/146
5,276,276 A 1/1994 Gunn
5,461,193 A 10/1995 Schertler
5,641,932 A 6/1997 Lace
5,898,121 A 4/1999 Riboloff
5,925,839 A 7/1999 Schertler

* cited by examiner

*Primary Examiner*—Lincoln Donovan
*Assistant Examiner*—David S. Warren
(74) *Attorney, Agent, or Firm*—Peter K. Hahn; Luce, Forward, Hamilton & Scripps, LLP

(57) ABSTRACT

The present invention provides a transducer for converting between mechanical vibration and electrical signal, the transducer comprising a housing enclosing a substantially cylindrical permanent magnet and a coil, the magnet having a side-to-side polar orientation. The transducer may be used as sensor that is part of a sensor array for detecting vibrations from a hollow-bodied musical instrument and converting the vibrations into electrical signals for amplification.

28 Claims, 6 Drawing Sheets

TRANSDUCER FOR CONVERTING BETWEEN MECHANICAL VIBRATION AND ELECTRICAL SIGNAL

REFERENCE TO RELATED APPLICATIONS

This application is a Continuation-In-Part of U.S. patent application Ser. No. 10/085,975, now U.S. Pat. No. 7,132,597 entitled TRANSDUCER FOR CONVERTING BETWEEN MECHANICAL VIBRATION AND ELECTRICAL SIGNAL, filed Feb. 26, 2002.

FIELD OF THE INVENTION

The present invention is directed to acoustic-magnetic sensors, and more particularly to one or more acoustic-magnetic sensors providing vibrational amplification for a musical instrument, such as a guitar.

BACKGROUND OF THE INVENTION

It has long been recognized that electrical current will induce a magnetic field, and that a moving magnetic field can induce current, or changes in the magnitude of a pre-existing current. One conventional application of this phenomenon is the transducer for converting between current and vibration. More particularly, a transducer for converting between vibration and current can: (1) convert linear mechanical vibration (e.g., acoustic vibration) into a pattern of variations in electrical current; and/or (2) convert variations in a current into vibration. Such a transducer can be used to produce electrical signals from the vibrations of a musical instrument, such as a guitar.

In a guitar, taut strings are vibrated to induce acoustic vibrations in the guitar body and the air surrounding the guitar. One or more transducers may be fixed to some part of the guitar. The vibrations of the guitar induce relative vibration between a coil and a permanent magnet in each transducer. This induced relative vibration causes current patterns in the coil. The current in the coil is usually amplified and sent to a speaker to produce louder and better-directed sound corresponding to the vibration of the guitar.

A variety of transducers have been used to convert the vibrations of a guitar into electrical current patterns. One common type involves the use of one or more piezoelectric crystals. However, such transducers suffer from a number of known drawbacks. One drawback is that piezocrystals tend to produce an unattractive sound distortion that is especially problematic when amplified.

Some guitars, such as disclosed in U.S. Pat. No. 5,898,121, employ string sensors or pickups, which are disposed generally beneath the strings and are adapted to convert the vibrational energy from the strings into electrical signals that can be amplified. Other guitars, such as disclosed in U.S. Pat. No. 3,624,264, use sensors attached to the guitar soundboard to translate the motion of the soundboard into electrical signals. One drawback of using conventional transducers as string sensors is that they only vibrate linearly, thereby limiting sound quality characteristics in the areas of feedback, attach, sustain, equalization and dynamic range.

In view of the above, there exists a need for a transducer having improved vibrational characteristics for producing high quality sound.

SUMMARY OF THE INVENTION

The present invention provides a transducer having improved vibrational characteristics for producing high quality sound. In one application, the transducer comprises a sensor used to detect vibrations from a hollow-bodied musical instrument, such as an acoustic guitar, and convert the vibrations into electrical signals for amplification. Additionally, the transducer may be employed as a sensor as part of a sensor array including a plurality of sensors for detecting musical instrument vibrations.

One aspect of the present invention involves a transducer for a musical instrument for converting between mechanical vibration and electrical signal, wherein the transducer comprises a housing enclosing a substantially cylindrical permanent magnet and a coil and the magnet is configured to have a side-to-side polar orientation. In other words, the magnet includes one north pole and one south pole disposed along a line that is substantially perpendicular to the central axis.

Another aspect of the present invention involves a transducer for a musical instrument for converting between mechanical vibration and electrical signal, wherein the transducer comprises a housing enclosing a substantially cylindrical permanent magnet and a coil and the magnet is suspended in ferrofluid within the housing. The ferrofluid acts as a liquid spring for the magnet and also damps external vibrations that cause the magnet to vibrate. According to some embodiments, the ferrofluid comprises a natural or synthetic oil. The transducer may further comprise a metal insert embedded within the housing, which prevents the magnet from freely spinning within the housing.

A further aspect of the present invention involves a sensor array for a musical instrument having a soundboard, the sensor array comprising one or more sensors for converting between mechanical vibration and electrical signal, each sensor comprising a transducer including a housing enclosing a substantially cylindrical permanent magnet and a coil. Each magnet is preferably configured to have a side-to-side polar orientation and is disposed at distinct locations on an interior surface of the soundboard. According to some embodiments, each sensor further comprises ferrofluid that fills the housing and substantially surrounds the magnet. The ferrofluid acts as a liquid spring for the magnet and also damps external vibrations that cause the magnet to vibrate. According to some embodiments, the ferrofluid comprises a natural or synthetic oil. The transducer may further comprise a metal insert embedded within the housing, which prevents the magnet from freely spinning within the housing.

In the area of acoustic transducers, and especially transducers for picking up vibrations of a guitar, the design flexibility provided by ferrofluid, damping liquid and/or rotational vibration can help optimize sound quality characteristics, including characteristics in the following areas: (1) feedback; (2) attack; (3) sustain; (4) equalization; and (5) Dynamic Range. While there are words to describe sound quality characteristics, judgments about what sound quality is ultimately better or worse is necessarily artistic, subjective and context driven. However, by providing more options for variations in sound quality, a greater number of musical artists and listeners will be able to achieve the sound quality that is respectively more optimal for them and their particular acoustic expressions.

These and other features and advantages of the present invention will be appreciated from review of the following detailed description of the invention, along with the accompanying figures in which like reference numerals refer to like parts throughout.

BRIEF DESCRIPTION OF THE DRAWINGS

FIG. 9A is a schematic wiring diagram depicting an array of sensors coupled in series, while

DETAILED DESCRIPTION

In the following paragraphs, the present invention will be described in detail by way of example with reference to the attached drawings. Throughout this description, the preferred embodiment and examples shown should be considered as exemplars, rather than as limitations on the present invention. As used herein, the "present invention" refers to any one of the embodiments of the invention described herein, and any equivalents. Furthermore, reference to various feature(s) of the "present invention" throughout this document does not mean that all claimed embodiments or methods must include the referenced feature(s).

Figure 1:
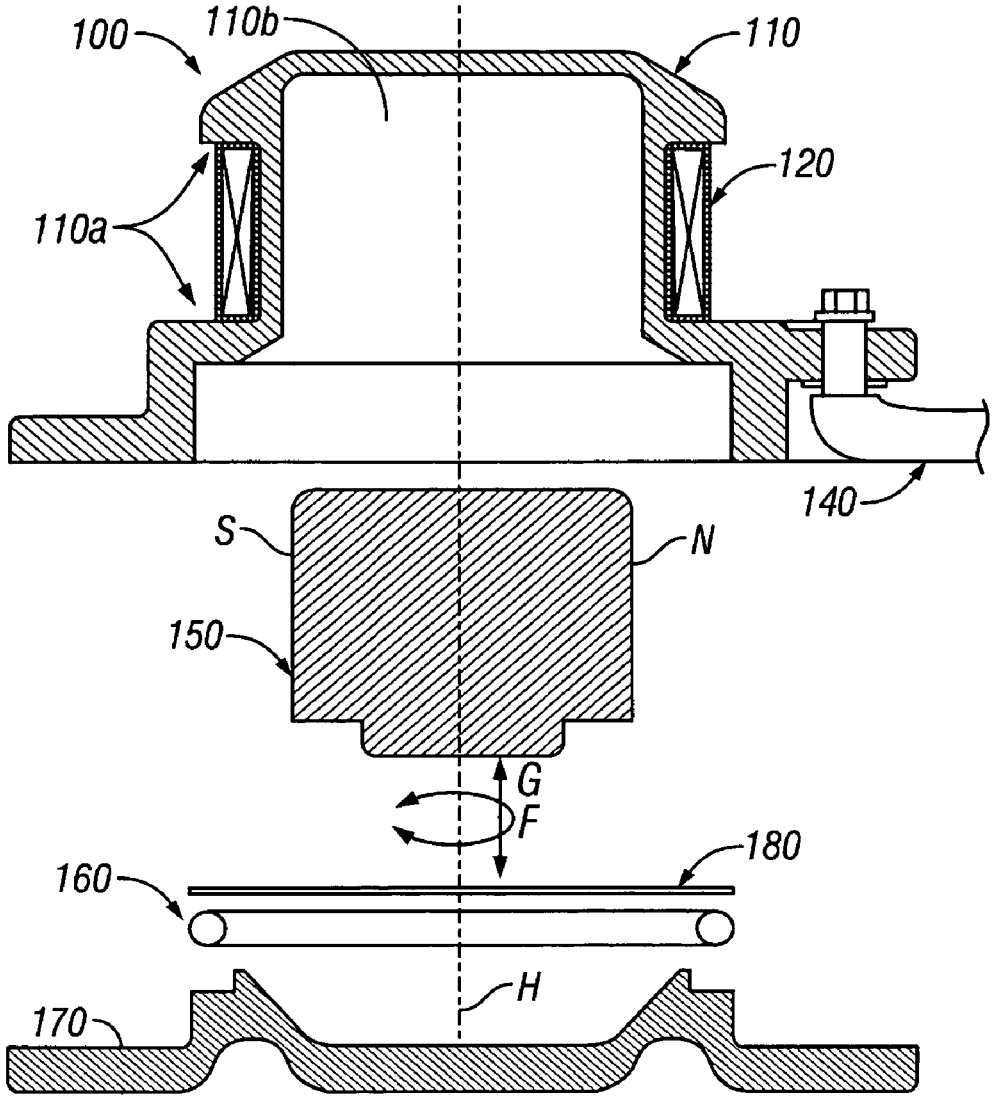
FIG. 1 is an exploded cross-sectional view of a sensor in accordance with the principles of the present invention.
Figure 2:
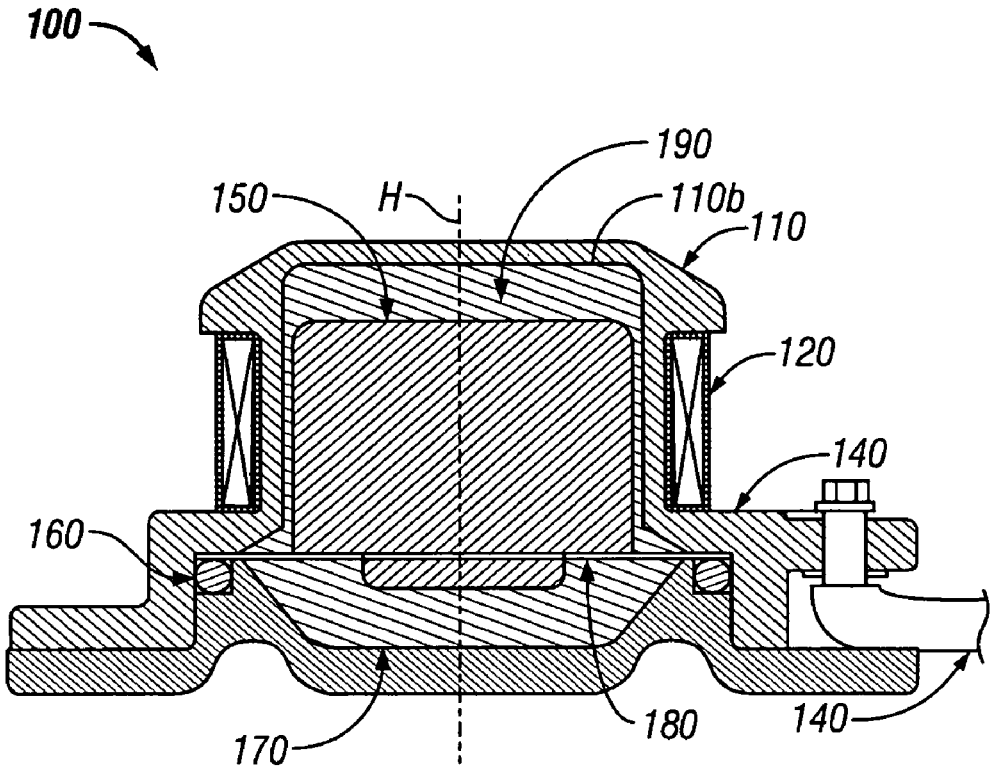
FIG. 2 is a non-exploded cross-sectional view of the sensor of FIG. 1.

A sensor 100 having improved vibrational characteristics for producing high quality sound in accordance with the principles of the present invention will now be described with reference to FIGS. 1 and 2. Referring to FIG. 1, sensor 100 preferably comprises an electromagnetic transducer including housing 110, coil 120, leads 140, permanent magnet 150, gasket 160, cap 170 and diaphragm 180. Referring to FIG. 2, housing 110 is substantially liquid tight such that it holds damping liquid 190 within its interior space. Preferably, damping liquid 190 substantially fills housing 110 so that it will always surround the moving components within the housing, regardless of the orientation of the housing with respect to the gravitational field.

Damping liquid 190 damps external vibrations that tend to cause permanent magnet 150 to vibrate. Housing 110 includes a bobbin portion 110*a* and an interior cavity 110*b*. The bobbin portion is a spool that constrains coil 120 to the housing. The cavity potion 110*b* accommodates vibrating magnet 150. The material selected for housing 110 should provide any necessary damping and shielding, but it should be kept in mind that the need for damping may be limited because of damping liquid 190. Suitable materials for housing 110 include acetyl resin, ABS plastic, DELRIN and other plastics.

Damping fluid 190 preferably is put into cavity portion 110*b* when the transducer is assembled. More particularly, the damping fluid and the magnet/diaphragm assembly are inserted into the cavity. Then, gasket 160 and cap 170 are secured over housing 110 and the outer periphery portion 220 of diaphragm 180. For example, cap 170 can be secured with an adhesive or by an interference fit with housing 110. Gasket 160 preferably is formed as an elastic O-ring. Gasket 160 seals the juncture between cavity 110*b* and cap 170 to prevent fluid leakage. Suitable materials for damping fluid 190 include shock absorber fluid and hydraulic fluid.

Coil 120 is an electric signal carrier that is coil shaped. It is common to use coil shaped carriers in electromagnetic transducers because this geometry allows a long length of current carrier to be in close proximity to a moving magnetic field that is centered within the coil. In this embodiment, permanent magnet 150 vibrates relative to housing 110 and coil 120. Of course, the design can be varied so that the coil vibrates relative to the housing in addition to or instead of the magnet without departing from the scope of the present invention.

Figure 3:
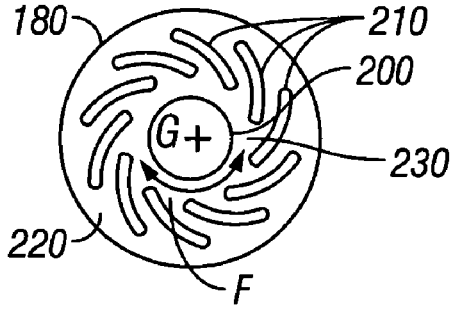
FIG. 3 is a top plan view of an embodiment of a diaphragm for the sensor of FIG. 1.

Referring to FIG. 3, diaphragm 180 is used to convert linear vibrational motion into a more complex vibrational motion that has both linear and rotational components. Diaphragm 180 is a thin disk-shaped leaf spring having a central aperture 200 and a set of curved, elongated apertures 210 defined therein. Referring to FIG. 1, the outer periphery 220 of diaphragm 180 is fixed while the inner periphery 230 can be displaced in a direction indicated by arrow G. When the diaphragm is displaced, the inner periphery 230 rotates relative to the fixed outer periphery 220 in a direction indicated by arrow F. This rotation is due in part to the geometry of the curved, elongated apertures 210, which help the transducer pick up lateral movement, thereby providing a more accurate reading of the movement of the musical instrument.

When the diaphragm vibrates in a linear direction normal to its major surfaces, the inner periphery 230 rotates about center axis H over a range of angles. More particularly, permanent magnet 150 is fixed to central aperture 200 of diaphragm 180 such that the magnet moves with the inner periphery 230 of diaphragm 180 as the diaphragm is driven to vibrate with external vibration. Diaphragm 180 is preferably made of a polyester film, such as MYLAR, so that it will be strong and elastic. Leads 140 provide a path for the electric signal induced in coil 120 to get to external components, such as including amplifiers and speakers.

The sinusoidal, vector sum characteristics of a sensor with rotational motion make it difficult to analytically predict what sensor will perform best for a musical instrument. Springs, like diaphragm 180, can be designed to provide more or less rotational displacement per unit linear displacement. The balance between linear vibration and rotational vibration is a design variable that should be optimized for a given application or audience. Different sensors should be tried and their respective output signal should be compared by ear and/or by software, so that the output signal will have the best characteristics (e.g., audio characteristics) for the job at hand.

Figure 4:
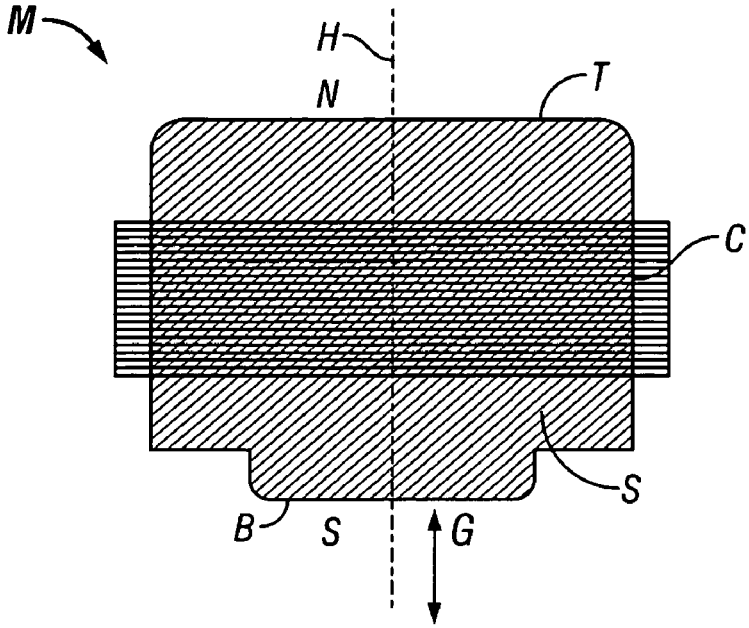
FIG. 4 (Prior Art)
FIG. 4 (PRIOR ART) is a side view of a conventional permanent magnet having an end-to-end polar orientation.

Referring to FIG. 4 (PRIOR ART), a conventional sensor comprises a permanent magnet M that is substantially cylindrical including top end T, bottom end B, curvilinear side surface S. Coil C is wound many times around the permanent magnet such that coil C is disposed substantially perpendicular to central axis H. Permanent magnet M is adapted to be displaced along central axis H in a direction indicated by arrow G. Additionally, permanent magnet M is constructed to have one north pole N and one south pole S disposed along central axis H at top end T and bottom end B of permanent magnet M, respectively. In other words, north pole N and south pole S are disposed along the axis of movement of the magnet, thereby forming a conventional end-to-end polar orientation.

Figure 5:
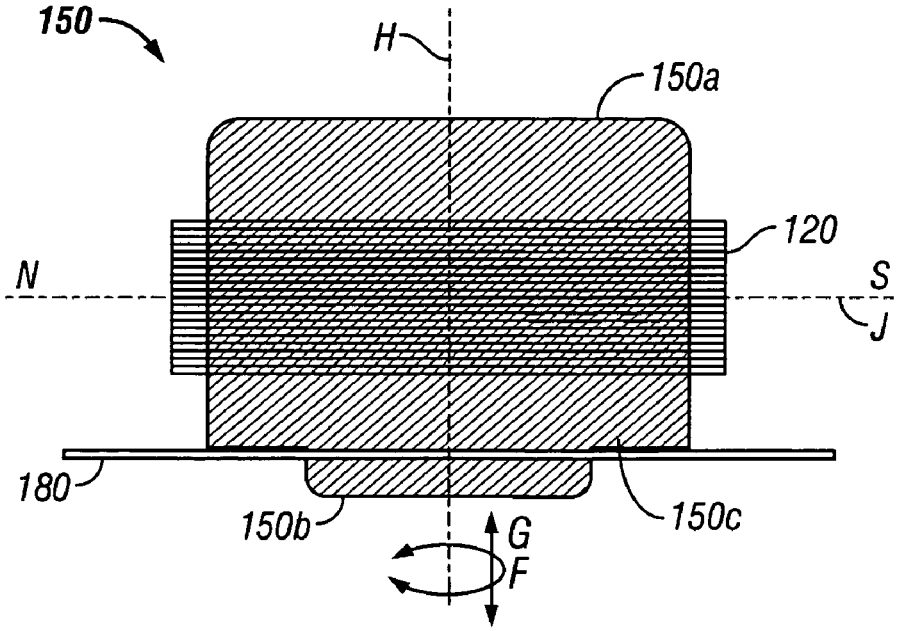
FIG. 5 is a side view of a permanent magnet having an side-to-side polar orientation according to the principles of the present invention.

Referring to FIG. 5, a permanent magnet 150 comprises a top end 150*a*, a bottom end 150*b* and a curvilinear side surface 150*c*. Diaphragm 180 is attached to the magnet at bottom end 150*b*. According to an aspect of the present invention, permanent magnet 150 is constructed to have one north pole N and one south pole S disposed along line J, which is substantially perpendicular to central axis H. In other words, magnet 150 is formed having a side-to-side polar orientation rather than end-to-end. A side-to-side polar orientation is preferable because it takes advantage of both linear and rotational aspects of the vibration. In addition, permanent magnet 150 produces a higher output with less movement when compared with the convention permanent magnet M described with respect to FIG. 4.

With further reference to FIG. 5, external vibrations cause the inner periphery 230 of diaphragm 180 to vibrate linearly in the direction of arrow G and also to vibrate rotationally in the direction of arrow F. This means that magnet 150 will also vibrate both linearly and rotationally. Both the linear and rotational aspects of the vibration of magnet 150 tend to induce current changes in coil 120. The strength of the induced electrical signal corresponds with the vector sum of the linear vibration and the normal component of the rotational vibration. By aligning the poles about central axis H, rather than along the central axis, this vector sum is maximized. This will provide the strongest output electrical signal for a given magnitude of input mechanical vibration.

In the illustrated embodiment, permanent magnet 150 comprises a single north pole N and a single south pole S formed on opposite sides of curvilinear side surface 150*c*. According to other embodiments, permanent magnet 150 may include a plurality of north and south poles arranged in an alternating fashion circumferentially about curvilinear side surface 150*c*. Such a multi-pole magnet includes a more sharply varying magnetic field as taken in the angular direction of the coil. The resultant electric signal induced in the coil tends to be stronger and has a different quality than a conventional linear motion transducer. Of course, permanent magnet 150 may have different shapes and polar orientations without departing from the scope of the present invention.

Figure 6:
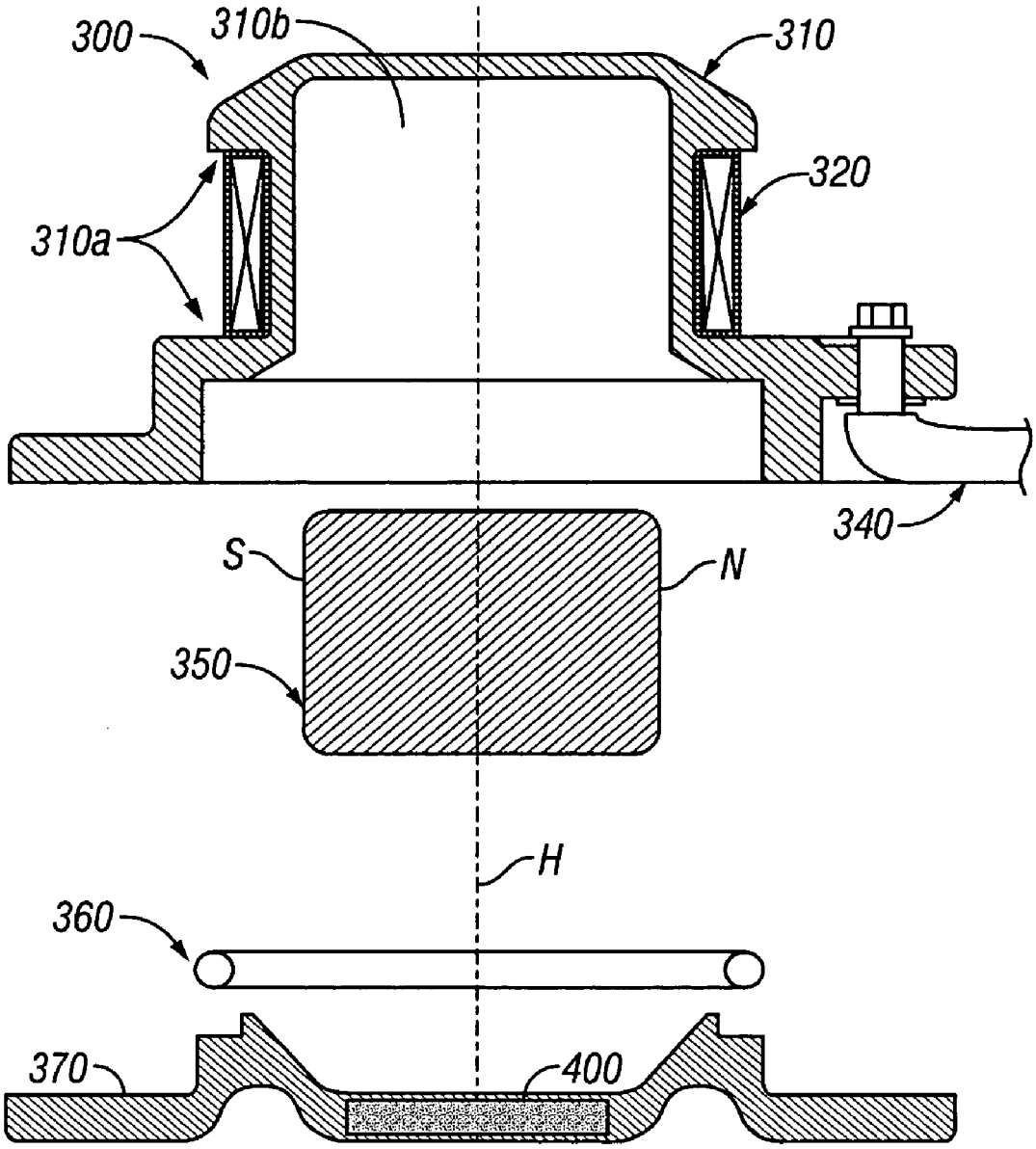
FIG. 6 is an exploded cross-sectional view of an alternative sensor in accordance with the principles of the present invention.

An alternative sensor 300 having improved vibrational characteristics for producing high quality sound in accordance with the principles of the present invention will now be described with reference to FIGS. 6 and 7. Referring to FIG. 6, sensor 300 comprises an electromagnetic transducer including a substantially liquid tight housing 310, coil 320, leads 340, permanent magnet 350, gasket 360, and cap 370. Housing 310 includes a bobbin portion 310*a* comprising a spool that constrains coil 320 to the housing, and an interior cavity 310*b* that accommodates vibrating magnet 350. Suitable materials for housing 310 include acetyl resin, ABS plastic, DELRIN and other plastics. Permanent magnet 350 preferably comprises one north pole N and one south pole S disposed along a line that is substantially perpendicular to central axis H. In other words, magnet 150 is formed having a side-to-side polar orientation rather than end-to-end. This side-to-side polar orientation is preferable because it takes advantage of both linear and rotational aspects of the vibration and produces a higher output with less movement.

Figure 7:
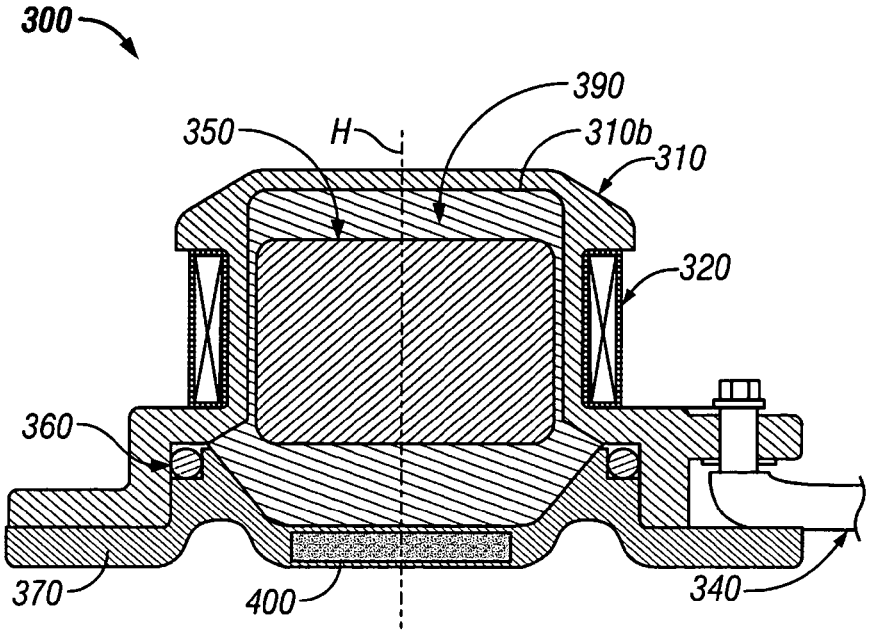
FIG. 7 is a non-exploded cross-sectional view of the sensor of FIG. 6.

Referring to FIG. 7, housing 310 preferably holds ferrofluid 390, or other liquid that is responsive to magnetic fields, within its interior space. Those skilled in the art will appreciate that ferrofluid is designed to be responsive to magnetic fields while in a liquid state and are commonly available on the open market. One example of a ferrofluid is FF-310 made by FerroTec (USA) Corporation (Nashua, N.H.). Ferrofluid 390 substantially fills housing 310 so that it will always surround the moving components within the housing, regardless of the orientation of the housing with respect to the gravitational field. Magnet 350 is suspended in ferrofluid 390 within housing 310. Advantageously, the ferrofluid acts as a liquid spring allowing the magnet to vibrate in all directions. Additionally, ferrofluid 390 dampens the movement of magnet 150. According to some embodiments, an elongate metal insert 400 is embedded within cap 370 to attract magnet 350 such that the north and south poles are substantially constant with respect to metal insert 400. Metal insert 400 prevents magnet 350 from freely spinning within housing 310. Of course, as would be appreciated by those of skill in the art, metal insert may also be embedded within housing 310 without departing from the scope of the present invention.

Ferrofluid 390 preferably comprises a multiplicity of small ferrous magnetic particles within a liquid. Suitable liquids include natural and synthetic oils. The magnetic moments of the ferrous particles are randomly distributed in the absence of a magnetic field and have no net magnetization. When a magnetic field is applied to ferrofluid 390, the moments of the particles orient along the magnetic field lines. Thus, ferrofluid 390 is displaced in response to changes in the magnetic field, and the movement of the ferrofluid causes corresponding changes in inductance in the coil 320. Leads 340 provide a path for the electric signal induced in coil 320 to get to external components.

In a preferred embodiment, the ferrofluid and permanent magnet are inserted into cavity portion 310*b* when the transducer is assembled. Then, gasket 360 and cap 370 are secured over housing 310, for example using an adhesive or by interference fit. Gasket 360 seals the juncture between cavity 310*b* and cap 370 to prevent fluid leakage. The elongate metal insert 400 embedded within cap 370 automatically aligns the north and south poles and prevents magnet 350 from spinning freely within the housing.

One advantage of the sensors of the present invention are their small size (less than an inch around, less than an inch high). The small size is largely the result of the efficiency of converting externally-supplied vibrations to both linear and rotational vibration. The rotational aspect allows more relative motion between the magnetic field and the coil, without substantially increasing the size of the transducer. Because the transducer is so small it will tend to have a good high frequency response, which makes it good for transducing the acoustic vibrations of musical instruments. Also, the small size of the transducer keeps it from being a significant vibrational load even when it is attached to the source of a musical instrument.

Figure 8:
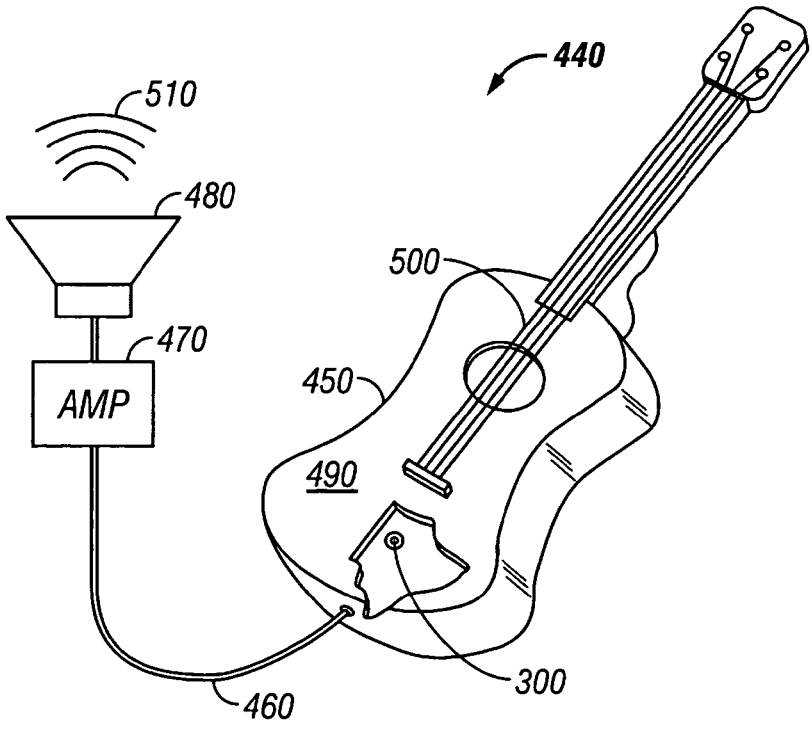
FIG. 8 is a cutaway view of a musical instrument including the sensor of FIG. 6.

FIG. 8 shows musical instrument assembly 440 including an acoustic guitar 450, sensor 300, leads 460, amplifier 470 and speaker 480. In the illustrated embodiment, sensor 300 is attached to an interior surface of the soundboard 490 of acoustic guitar 450. However, as would be understood to those of ordinary skill in the art, sensor 300, or a plurality of sensors 300 may be placed at other locations on the musical instrument without departing from the scope of the present invention. Sensor 300 is preferably attached by adhesive, but may alternatively be attached using conventional fasteners such as screws, nails, bolts, rivets or hook and loop fasteners. The placement of the sensor on the musical instrument may affect the frequency distribution and/or magnitude of the acoustic vibrations that are received. Therefore, some trial and error may be needed to optimally place the sensor on the acoustic guitar.

When playing the acoustic guitar, strings 500 are vibrated by plucking or strumming, which causes the entire body to vibrate. This vibration will be communicated through the air and through the guitar body to the sensor. As explained above, this external vibration may be dampened by the sensor housing and/or by damping liquid. Also, the vibration may be converted, in whole or in part, to a rotational vibration in the sensor. The electric signal transduced in the sensor is sent by leads 460 out to amplifier 470. Amplifier 470 is preferably a standard amplifier for amplifying musical instruments based on a signal from a sensor. An amplified signal is then sent to speaker 480 where it is transduced back into sound 510.

Figure 9A:
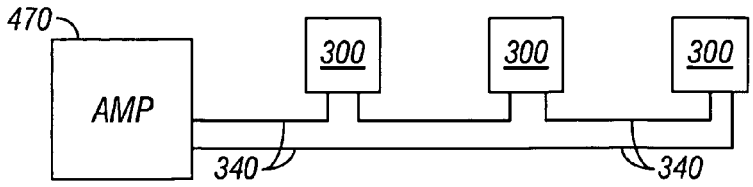
Figure 9B:
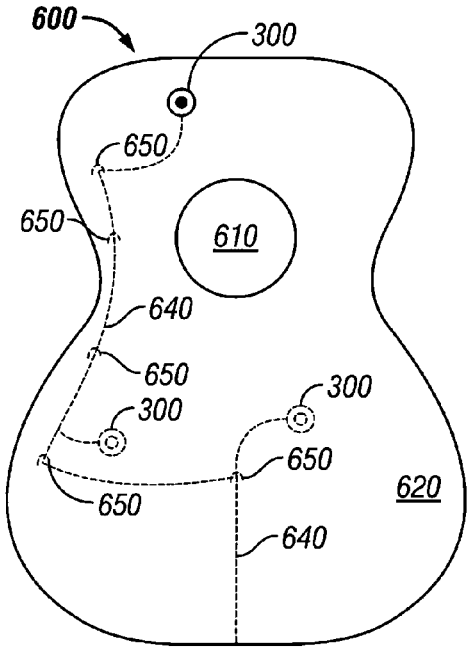
FIGS. 9B and 9C are top plan views of an exterior and interior surface, respectively, of a soundboard of a musical instrument including a sensor array in accordance with the principles of the present invention.
Figure 9C:
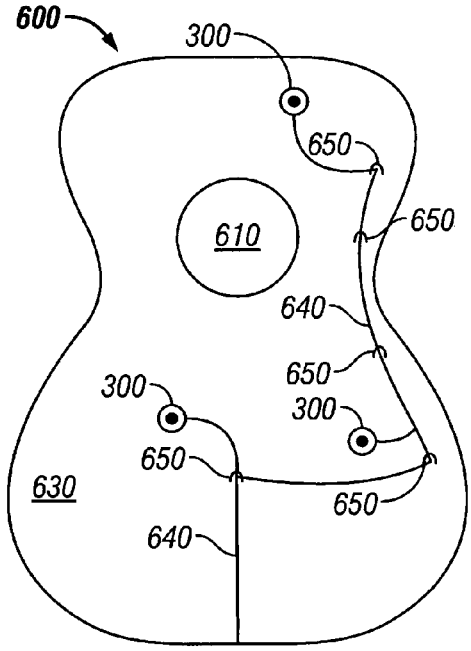

FIG. 9A is a schematic wiring diagram depicting three sensors 300 coupled in series by leads 340. Of course, other sensors such as sensors 100 described with respect to FIG. 1 or any other suitable sound sensors may be employed without departing from the scope of the present invention. The electric signal transduced in the string sensors and sensors is sent by leads 340 out to amplifier 470. FIGS. 9B and 9C show an acoustic guitar soundboard 600 including sound port 610 and an array of electromagnetic sensors 300 connected in series. More particularly, FIG. 9B shows a top plan view of the exterior surface 620 of soundboard 600 and FIG. 9C shows a top plan view of the interior surface 630 of soundboard 600. The sensor array is adapted to pick up vibrational energy at separate and distinct locations on the guitar soundboard and convert the combined vibrational energy into electrical signals for amplification. As will be appreciated by those of skill in the musical arts, the electromagnetic sensor array can be used with other stringed musical instruments, including, but not limited to, violins, cellos, basses, sitars, mandolins and violas, without departing from the scope of the present invention.

In a preferred embodiment, the electromagnetic sensor array comprises an array of sensors 300 coupled in series by leads 640. Leads 640 are attached to the interior surface of soundboard 600 using suitable fasteners such as U-shaped tacks 650. Sensors 300 preferably are attached to the soundboard such that the bottom surface of cap 370 is substantially flush with the interior surface of soundboard 600. One suitable attachment means is a thin layer of adhesive between the cap and the soundboard. Alternatively, the sensors may be attached using convention fasteners such as screws, nails, tacks or VELCRO. All sensors 300 are preferably attached to the interior surface of soundboard 600 such that they are substantially oriented in a single direction. Leads 640 provide a path for the electric signal to get to external components such as an amplifier and speaker.

Referring to FIGS. 9B and 9C, different areas of the soundboard produce different vibrations and sounds when the guitar is played. Sensors 300 are preferably located in distinct and separate areas in order to pick up a broader range of acoustic expression. In operation, the sensors interact physically with each other such that the combination of sensors produces a different sound than would the sum of the sensors. However, choosing the exact location on the soundboard for the sensors for a particular guitar is not an exact science, but rather an exercise in trial and error.

Guitar soundboards include natural body movement areas or hot spots, which are vibration points that tend to reflect the same frequency and tonal quality of the guitar as one hears directly. The sensors of the present invention are adapted to pick up overtones by the guitar strings interacting with the soundboard. Preferably, sensors 300 should be strategically placed on the soundboard adjacent the hot spots. However, this may require a significant amount of testing. In other words, each sensor 300 should be moved about different locations on the interior surface of soundboard 600 in order to locate hot spots that result in the production of a sound through an electronic amplifier similar to that which one hears directly.

The placement of sensors 300 should also take advantage of the natural phase relationship of the soundboard. At times, the sensors will cancel each other out, which is an acceptable result since certain guitar sounds naturally cancel each other out. Proper placement of the sensors will reduce phase problems that may cause feedback at high volumes. Locating areas on the soundboard that result in a reduction of phase problems also requires some trial and error. In the illustrated embodiment, the sensor array includes three sensors 300. However, as would be understood by those of ordinary skill in the art, any number of sensors may be employed without departing from the scope of the present invention. Ideally, the sensor array will include sensors located at as many distinct locations on the soundboard as possible. However, such an arrangement would require perhaps hundreds of individual sensors and would, therefore, be prohibitively expensive.

Thus, it is seen that a transducer for converting between mechanical vibration and electrical signal is provided. One skilled in the art will appreciate that the present invention can be practiced by other than the various embodiments and preferred embodiments, which are presented in this description for purposes of illustration and not of limitation, and the present invention is limited only by the claims that follow. It is noted that equivalents for the particular embodiments discussed in this description may practice the invention as well.

What is claimed is:

1. A transducer, comprising:

a housing enclosing a substantially cylindrical permanent magnet, the magnet comprising a first end face, a second end face and a curvilinear side surface; and a coil coupled to the housing, wherein the magnet is configured to have a side-to-side polar orientation, and wherein the magnet and housing are configured such that the magnet moves relative to the coil both linearly and rotationally thereby converting mechanical vibration to an electrical signal.

2. The transducer of claim 1, wherein:

the magnet comprises a longitudinal axis passing through the first and second end faces; and the magnet includes one semi-cylindrical north pole and one semi-cylindrical south pole disposed along a line that is substantially perpendicular to the longitudinal axis.

3. The transducer of claim 1, wherein the magnet is attached to the housing via a diaphragm.

4. The transducer of claim 3, wherein the diaphragm permits the magnet to vibrate linearly and rotationally within the housing.

5. The transducer of claim 1, wherein the magnet is adapted to vibrate within the housing.

6. The transducer of claim 5, wherein the vibration of the magnet induces current changes in the coil.

7. The transducer of claim 1, wherein the housing includes a bobbin portion that constrains the coil to the housing.

8. The transducer of claim 1, further comprising a metal insert embedded within the housing.

9. The transducer of claim 8, wherein the metal insert is configured such that the magnet is prevented from freely spinning within the housing.

10. A transducer, comprising:

a housing enclosing a substantially cylindrical permanent magnet, the magnet comprising a first end face, a second end face and a curvilinear side surface; and a coil coupled to the housing;

wherein the magnet is configured to have a side-to-side polar orientation and is suspended in ferrofluid within the housing, and wherein the magnet is adapted to move relative to the coil thereby converting mechanical vibration to an electrical signal.

11. The transducer of claim 10, wherein:

the magnet comprises a longitudinal axis passing through the middle of the first and second end faces; and the magnet includes one north pole and one south pole disposed along a line that is substantially perpendicular to the longitudinal axis.

12. The transducer of claim 10, wherein the ferrofluid acts as a liquid spring for the magnet.

13. The transducer of claim 10, wherein the ferrofluid is adapted to damp external vibrations that cause the magnet to vibrate.

14. The transducer of claim 10, wherein the ferrofluid comprises a natural or synthetic oil.

15. The transducer of claim 10, further comprising a metal insert embedded within the housing.

16. The transducer of claim 15, wherein the metal insert prevents the magnet from freely spinning within the housing.

17. The transducer of claim 10, wherein the vibration of the magnet induces current changes in the coil.

18. The transducer of claim 10, wherein the housing includes a bobbin portion that constrains the coil to the housing.

19. A sensor array for a musical instrument having a soundboard, comprising:

a plurality of sensors for converting mechanical vibration to an electrical signal, each sensor comprising a transducer including a housing enclosing a substantially cylindrical permanent magnet, and a coil, the magnet comprising a first end face, a second end face and a curvilinear side surface, wherein each magnet is configured to have a side-to-side polar orientation and to move relative to the coil, and wherein a first sensor is attached at a first position on the soundboard such that vibration of the first sensor is out of phase with vibration of a second sensor that is attached at a second position on the soundboard during vibration at a frequency due to the natural phase relationship of the soundboard.

20. The sensor array of claim 19, wherein the sensors are oriented substantially in the same direction.

21. The sensor array of claim 19, wherein the sensors are wired to an amplifier.

22. The sensor array of claim 19, wherein the sensors are attached to an interior surface of the soundboard such that each sensor is substantially hidden from view during use of the musical instrument.

23. The sensor array of claim 19, wherein the musical instrument is a guitar.

24. The sensor array of claim 19, wherein each sensor further comprises ferrofluid that fills the housing and substantially surrounds the magnet.

25. The sensor array of claim 24, wherein the ferrofluid acts as a liquid spring for the magnet.

26. The sensor array of claim 24, wherein the ferrofluid is adapted to damp external vibrations that cause the magnet to vibrate.

27. The sensor array of claim 24, wherein the ferrofluid comprises a natural or synthetic oil.

28. The sensor array of claim 19, wherein each sensor further comprises damping fluid filling the housing and substantially surrounding the magnet.

* * * * *